US009225132B2

(12) United States Patent
Kim

(10) Patent No.: US 9,225,132 B2
(45) **Date of Patent: *Dec. 29, 2015**

(54) CONNECTION PLUG FOR PORTABLE DEVICE

(75) Inventor: Jung-Hoon Kim, Seoul (KR)

(73) Assignee: Tyco Electronics AMP Korea Ltd., Kyungsangbuk-do (KR)

( * ) Notice: Subject to any disclaimer, the term of this patent is extended or adjusted under 35 U.S.C. 154(b) by 205 days.

This patent is subject to a terminal disclaimer.

(21) Appl. No.: 13/414,141

(22) Filed: Mar. 7, 2012

(65) Prior Publication Data

US 2012/0231643 A1 Sep. 13, 2012

(30) Foreign Application Priority Data

Mar. 7, 2011 (KR) ..... 10-2011-0020017

(51) Int. Cl.
*H01R 24/00* (2011.01)
*H01R 27/00* (2006.01)
*H01R 24/60* (2011.01)

(52) U.S. Cl.
CPC ..... *H01R 27/00* (2013.01); *H01R 24/60* (2013.01)

(58) Field of Classification Search
CPC .... H01R 12/79; H01R 12/724; H01R 12/727; H01R 13/6461; H01R 13/6471; H01R 13/65802
USPC ..... 439/660, 76.1, 79
See application file for complete search history.

(56) References Cited

U.S. PATENT DOCUMENTS

| | | | | |
|---|---|---|---|---|
| 7,572,071 | B1 * | 8/2009 | Wu | 385/94 |
| 7,618,293 | B2 * | 11/2009 | Wu | 439/660 |
| 7,651,379 | B1 | 1/2010 | Wu | |
| 7,713,093 | B2 | 5/2010 | Kim | |
| 7,736,184 | B1 * | 6/2010 | Wan et al. | 439/607.11 |
| 7,794,279 | B1 * | 9/2010 | Ye et al. | 439/607.54 |
| 7,909,653 | B1 * | 3/2011 | Wan et al. | 439/660 |
| 7,967,641 | B2 * | 6/2011 | Miyoshi | 439/660 |
| 8,079,879 | B2 * | 12/2011 | Chiang | 439/660 |
| 8,083,546 | B2 * | 12/2011 | Lee | 439/607.02 |
| 8,113,865 | B1 * | 2/2012 | Yang et al. | 439/353 |
| 8,118,497 | B2 * | 2/2012 | Yi | 385/93 |
| 8,371,882 | B1 * | 2/2013 | Szczesny et al. | 439/660 |
| 8,747,165 | B2 * | 6/2014 | Kim | 439/660 |

OTHER PUBLICATIONS

Chinese Office Action, dated Mar. 23, 2015, 7 pages.
English translation of Chinese Office Action, dated Mar. 23, 2015, 7 pages.

* cited by examiner

*Primary Examiner* — Xuong Chung Trans
(74) *Attorney, Agent, or Firm* — Barley Snyder

(57) ABSTRACT

A connection plug for a portable device is configured such that a single case is provided with different kinds of plug connection terminal units, which allows the single connection plug to perform functions of two kinds of connection plugs. The connection plug includes a case having an upper plug connection terminal unit and a lower plug connection terminal unit which are spaced apart from each other and disposed along upper and lower portions of the case respectively.

17 Claims, 9 Drawing Sheets

CONNECTION PLUG FOR PORTABLE DEVICE

CROSS-REFERENCE TO RELATED APPLICATION

This application claims the benefit of the filing dates under 35 U.S.C. §119(a)-(d) of Korean Patent Application No. 10-2011-0020016, filed on Mar. 7, 2011.

FIELD OF THE INVENTION

The present invention relates to a connection plug for a portable device, and more particularly to a connection plug having at least two kinds of plug connection terminal units installed with a single connection plug.

BACKGROUND

In general, commonly used portable devices have various functions including, for example, a video call function, information input/output function, data storage function as well as a simple voice call function.

With recent diversification in the functionality of portable devices, in particular, portable devices (hereinafter, also referred to as portable communication devices) have been provided with a variety of applications. In addition to a call function, specifically, recent portable devices may function as a storage medium containing personal information or other credit purchase information and also, may exhibit even somewhat complex functions, such as a picture or moving image capturing function, a music or moving image file reproduction function, a game playing function, a broadcast receiving function, and the like. In addition, multimedia devices that combine the aforementioned functions have been developed.

Portable devices are provided with various shapes of connection modules, which correspond to various connectable devices required to implement the above described various additional functions. Examples of these connectable devices and connection modules may include USB (Universal Serial Bus) ports for data reception/transmission and other input/output ports for connection of input/output units for signal interface, such as earphones, remote controllers and televisions.

Korean Patent Application No. 2007-0054532 (entitled "Connection Module for Mobile Communication Device") discloses a connection module in the form of an integral combination of two kinds of connection modules, in which different connection terminal units are installed to upper and lower portions of a single case, so as to allow different plugs to be connected to a single connection module.

With the integral configuration of the connection module, a slimmer connection module, which can properly conform to a slimmer mobile communication device, can be realized. However, currently, a slim plug suitable for use with the slimmer connection module is not present.

Specifically, although the size of a plug may be more or less reduced by reducing the number or size of terminals used in the plug, it is difficult to achieve a considerable reduction in the size of the plug equal to that in the integral configuration of the connection module.

Moreover, a single portable device may be used with several kinds of plugs on a per function basis and therefore, there exists a need for a plurality of plugs having different functions.

For example, in consideration of the fact that a variety of plugs having different functions, such as a USB plug to be connected to a USB connection module, an input/output plug to be connected to an input/output connection module, and the like, are utilized, a user may suffer from inconvenience in having to carry all various kinds of plugs for use with a single portable device.

SUMMARY

Therefore, the present invention has been made in view of the above problems, and it is one object of the invention, inter alia, to provide a connection plug for a portable device, in which different kinds of plugs are installed to a single case.

The connection plug is configured such that a single case is provided with different kinds of plug connection terminal units, which allows the single connection plug to perform functions of two kinds of connection plugs. The connection plug includes a case having an upper plug connection terminal unit and a lower plug connection terminal unit which are spaced apart from each other and disposed along upper and lower portions of the case respectively.

BRIEF DESCRIPTION OF PRE DRAWINGS

The above and other objects, features and other advantages of the present invention will be more clearly understood from the following detailed description taken in conjunction with the accompanying drawings, in which.

DETAILED DESCRIPTION OF THE EMBODIMENT(S)

Hereinafter, an exemplary embodiment of the present invention will be described in more detail with reference to the accompanying drawings.

Figure 1:
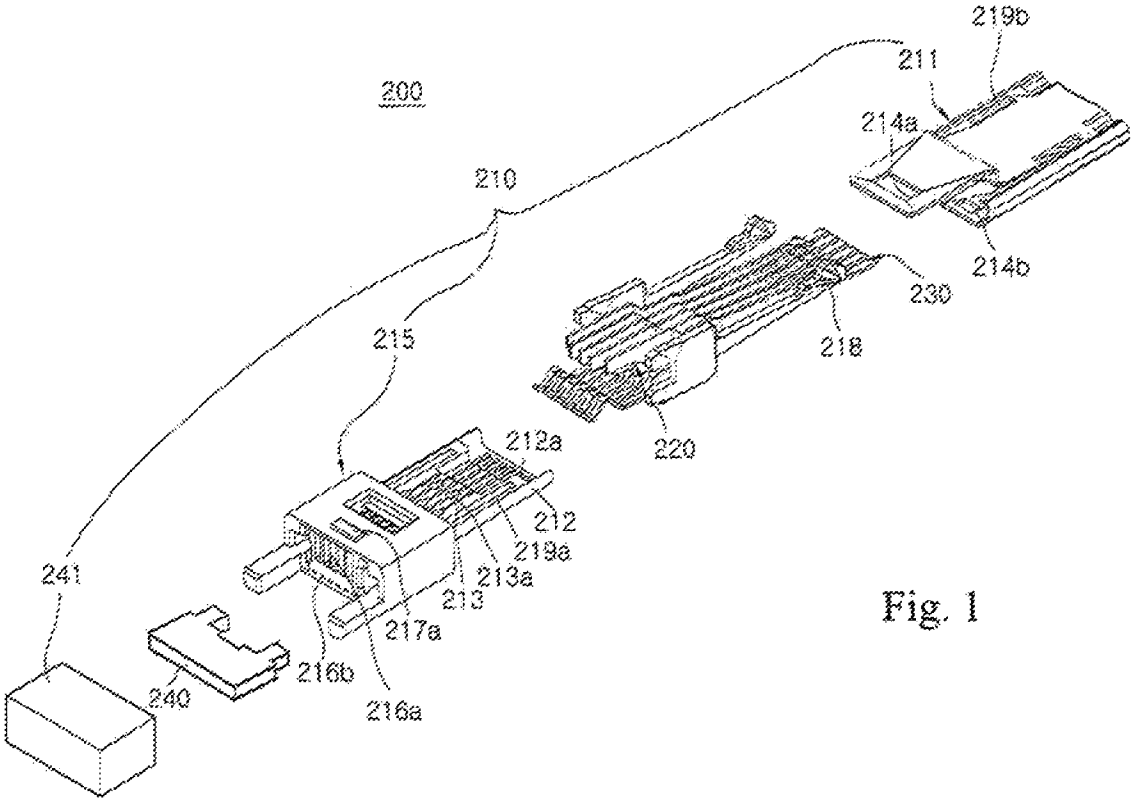
FIG. 1 is an exploded perspective view of a connection plug according to the invention.
Figure 2:
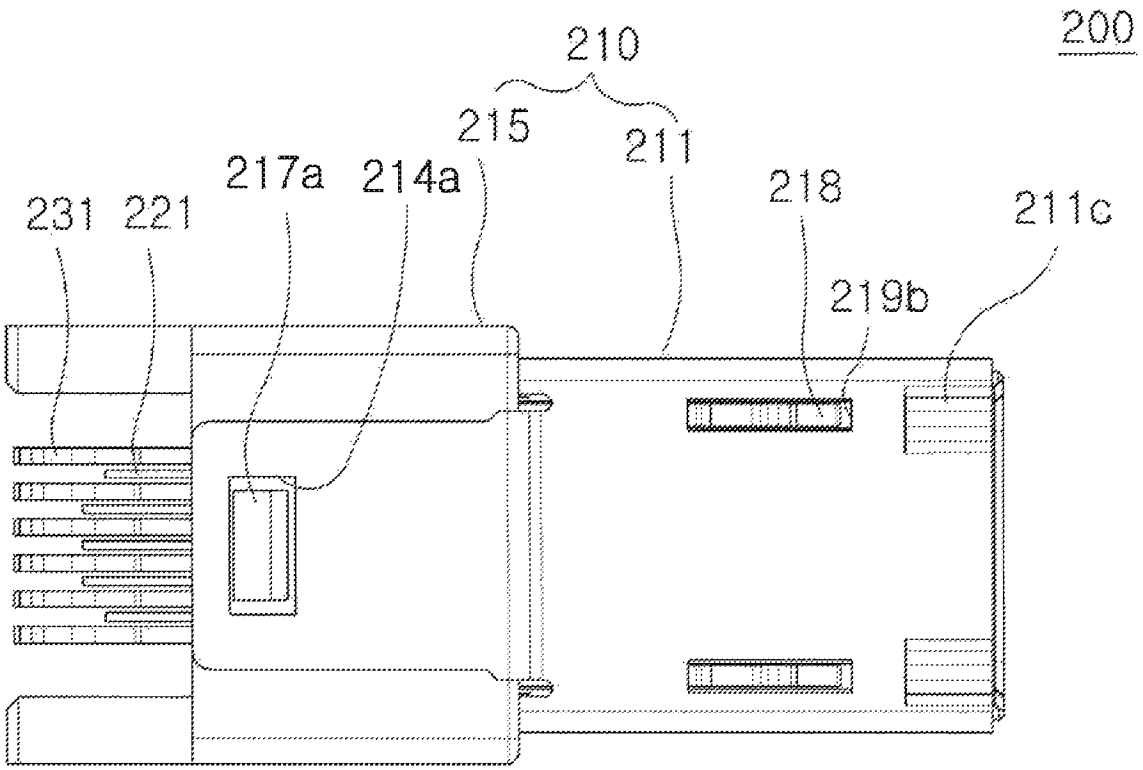
FIG. 2 is a plan view of the connection plug according to the invention.

With reference to FIGS. 1 and 2, a connection plug 200 for a portable device (not shown) in accordance with the invention is shown.

As shown, a connection plug 200 for a portable device is configured in such a manner that a single case 210 is provided with different kinds of plug connection terminal units 220 and 230, which allows the single connection plug 200 to perform functions of two kinds of connection plugs.

More particularly, the upper plug connection terminal unit 220 and the lower plug connection terminal unit 230 are spaced apart from each other within the case 210 and are installed respectively to upper and lower portions of the case 210. Here, upper plug connection terminals 221 constituting the upper plug connection terminal unit 220 and lower plug connection terminals 231 constituting the lower plug connection terminal unit 230 are alternately arranged at staggered positions.

Referring to FIG. 2, the upper plug connection terminals 221 are equidistantly spaced apart from one another by a predetermined distance. In this case, the lower plug connection terminals 231 are configured to have a width equal to or less than the predetermined distance between the upper plug connection terminals 221. As such, the lower plug connection terminals 231 are respectively positioned between the respective neighboring upper plug connection terminals 221.

With this configuration, as the upper plug connection terminals 221 and the lower plug connection terminals 231 are alternately arranged at staggered positions rather than facing each other, the upper plug connection terminals 221 and the lower plug connection terminals 231 can be engaged with each other when being located on the same plane, which prevents the upper plug connection terminals 221 from coming into contact with the lower plug connection terminals 231 even if the upper plug connection terminals 221 move downward.

As a result, as compared to the case in which the upper plug connection terminals 221 and the lower plug connection terminals 231 are arranged to face each other, an installation space for the respective connection terminals can be reduced and in turn, the volume of the entire connection plug 200 can be reduced.

In addition, the upper plug connection terminals 221 installed to the upper portion of the case 210 may be shorter than the lower plug connection terminals 231 installed to the lower portion of the case 210. This serves to prevent interference between the connection plug 200 and an associated socket 100 due to misalignment when the connection plug 200 is connected to the socket 100. Thus, it will be appreciated that the upper plug connection terminals 221 are not essentially shorter than the lower plug connection terminals 231, and the lower plug connection terminals 231 may be shorter than the upper plug connection terminals 221 according to the shapes of the connection plug 200 and the socket 100.

Preferably, the upper plug connection terminals 221 may have upwardly bulged distal ends, which can ensure easy connection with terminals of the socket 100.

In the embodiment, the case 210 includes an insertion case 211 configured to surround front portions of the upper and lower plug connection terminal units 220 and 230, and a terminal installation case 215, to which the upper and lower plug connection terminal units 220 and 230 are secured. When the connection plug 200 is connected to the socket 100, a front portion of the insertion case 211 is inserted into the socket 100 and thus, the insertion case 211 serves to guide connection between the upper and lower plug connection terminal units 220 and 230 and corresponding connection terminals units of the socket 100.

More particularly, the insertion case 211 takes the form of a box having open front and rear ends so as to surround the front portions of the upper and lower plug connection terminal units 220 and 230, the insertion case 211 being coupled to the terminal installation case 215. To this end, the insertion case 211 is provided at a rearward extension of an upper surface thereof with an upper coupling boss receiving passageway 214*a*, into which an upper coupling boss 217*a* formed at the terminal installation case 215 is inserted, and at a lower surface thereof with a lower coupling boss receiving passageway 214*b*, into which a lower coupling boss 217*b*, see FIG. 5A, formed at the terminal installation case 215 is inserted.

The upper surface of the insertion case 211 is further provided with an insertion guide receiving space 211*e*. When the insertion case 211 is inserted into the socket 100, an insertion guide 119 (see FIG. 7A) formed along the socket 100 is inserted into the insertion guide receiving space 211*c*, which restricts an insertion distance of the insertion case 211 with respect to the socket 100.

Figure 4:
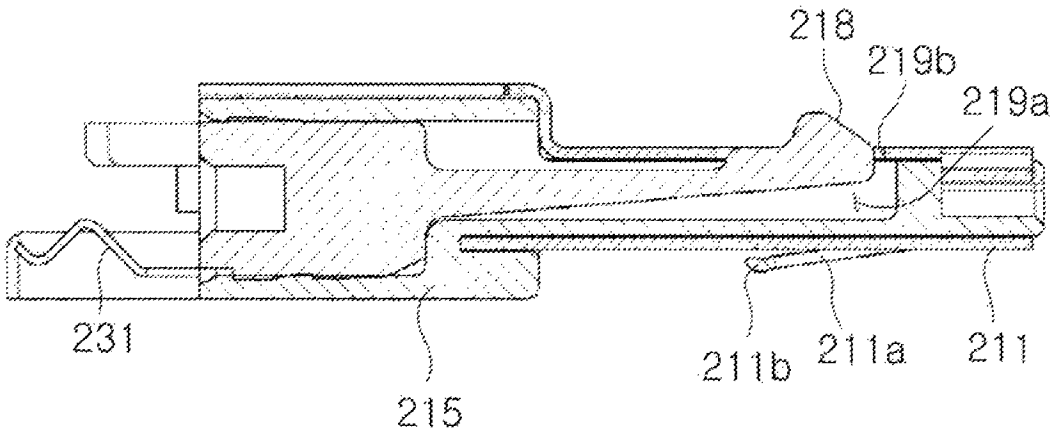
FIG. 4 is a sectional view of a socket coupling bar of the connection plug according to the invention.

The lower surface of the insertion case 211 is further provided with an elastic insert 211*a* (see FIG. 4). The elastic insert 211*a* is fabricated by incising a portion of the lower surface of the insertion case 211 and bending the incised portion so as to obliquely extend downward by an inclination suitable to exhibit elasticity. In this case, a protruding distal end of the elastic insert 211*a* is defined by a downwardly convex curved surface 211*b*.

Figure 3:
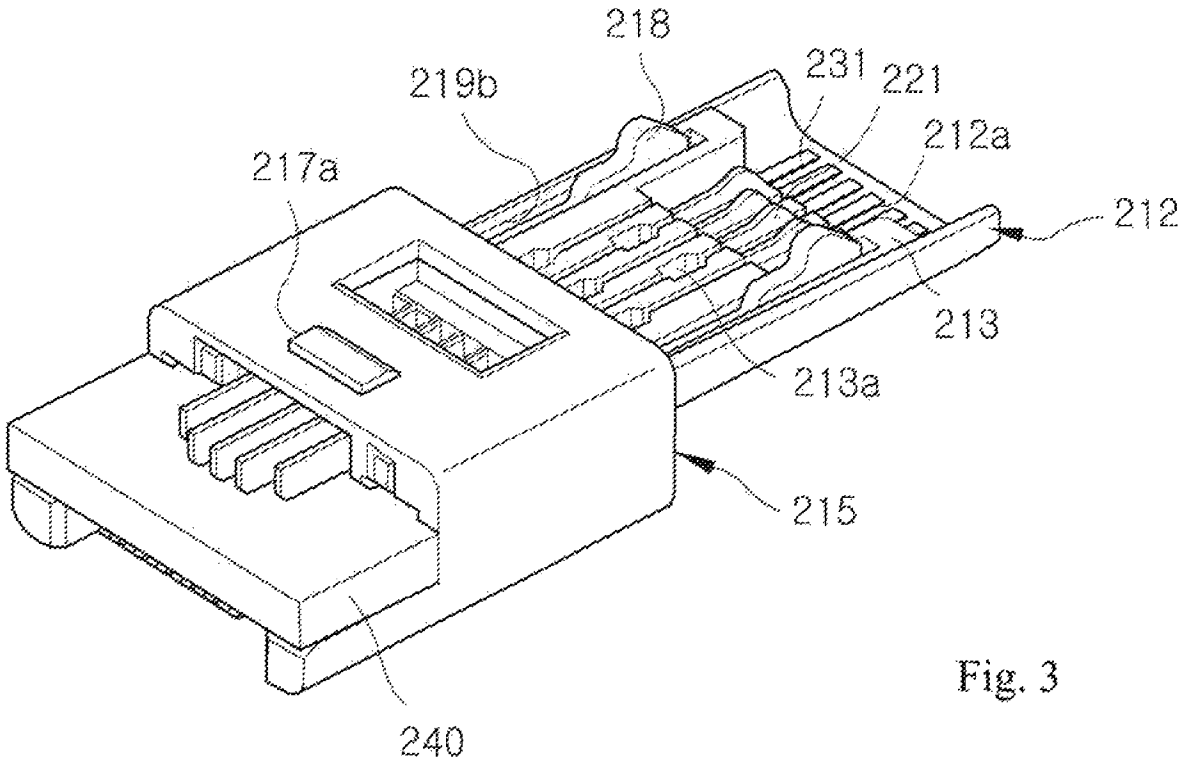
FIG. 3 is a partial perspective view of the connection plug according to the invention.

Referring to FIG. 3, the terminal installation case 215 is configured to receive the upper and lower plug connection terminal units 220 and 230 therein. The terminal installation case 215 is perforated in a rear end thereof with upper terminal receiving passageways 216*a* and lower terminal receiving passageways 216*b*, through which the upper and lower plug connection terminals 221 and 231 respectively penetrate. Preferably, the upper terminal receiving passageways 216*a* and the lower terminal receiving passageways 216*b* are arranged at staggered positions, so as to correspond to the upper plug connection terminals 221 and the lower plug connection terminals 231 which are alternately arranged at staggered positions.

The terminal installation case 215 includes a plate shaped lower mount 212 provided with lower insertion grooves 212*a* for insertion of the lower plug connection terminal unit 230. Specifically, the lower plug connection terminals 231 of the lower plug connection terminal unit 230 are respectively inserted into the lower insertion grooves 212*a* of the lower mount 212 such that upper surfaces of the lower plug connection terminals 231 are exposed.

The terminal installation case 215 further includes an upper mount 213 provided with upper insertion grooves 213*a* for insertion of the upper plug connection terminal unit 220. The upper mount 213 is located above the lower mount 212 so as to define a space between the upper plug connection terminal unit 220 and the lower plug connection terminal unit 230 and is shorter than the lower mount 212, thus being stepped with respect to the lower mount 212. The upper mount 213 may be configured to surround a lower surface of the upper plug connection terminal unit 230, and the upper insertion grooves 213*a* are configured to expose upper surfaces of the upper plug connection terminals 231 of the upper plug connection terminal unit 230.

Here, it will be appreciated that the upper insertion grooves 213*a* and the lower insertion grooves 212*a* are respectively aligned with the upper terminal receiving passageways 216*a* and the lower terminal receiving passageways 216*b* and thus, are alternately arranged at staggered positions.

As described above, the terminal installation case 215 is provided at an upper surface thereof with the upper coupling boss 217*a* for coupling with the insertion case 211, and at a lower surface thereof coming into contact with the insertion case 211 with the downwardly protruding lower coupling boss 217*b*.

In the terminal installation case 215 having the above described configuration, the lower plug connection terminal unit 230 is insert injection molded upon injection molding of the terminal installation case 215. Specifically, after the lower plug connection terminals 231 are arranged at positions where the lower plug connection terminal unit 230 has to be positioned, the lower mount 212 and the upper mount 213 are injection molded such that the upper surfaces of the lower plug connection terminals 231 are exposed. Thereafter, the upper plug connection terminals 231 are inserted through the upper terminal receiving passageways 216*a* of the upper mount 231 perforated in the rear end of the terminal installation case 215, thereby being assembled with the terminal installation case 215.

In the shown embodiment, a pair of socket coupling bars 218 is disposed at both sides of the upper and lower plug connection terminal units 220 and 230 and each has an upwardly bulged end.

Each of the socket coupling bars 218, as shown in FIG. 4, is inserted into a coupling bar installation groove 219*a* formed in either side of the upper mount 213 such that the upwardly bulged end of the socket coupling bar 218 protrudes upward from the upper surface of the insertion case 211.

In this case, the insertion case 211 has a coupling bar exposure slot 219*b* perforated in the upper surface thereof so as to expose the upwardly bulged end of the socket coupling bar 218.

Preferably, the socket coupling bar 218 is gently bent upward to exhibit elasticity, which assists in the socket coupling bar 218 easily passing through the coupling bar exposure slot 219*b* and also, easily being inserted into or separated from an associated coupling recess of the socket 100 when the connection plug 200 is connected to or separated from the socket 100.

In the shown embodiment, the upwardly bulged end of the socket coupling bar 218, which is exposed from the coupling bar exposure 219*b*, has a triangular shape provided with slopes in opposite directions in which the socket coupling bar 218 is coupled into and separated from the socket 100. As such, the socket coupling bar 218 can be easily coupled into or separated from the coupling recess of the socket 100.

In the shown embodiment, a circuit board 240 is attached to the rear end of the terminal installation case 215 and is connected to the upper and lower plug connection terminal units 220 and 230. The circuit board 240 performs reception/transmission of electric signals so as to assist in the respective plug connection terminal units 220 and 230 performing plug functions. In addition, a circuit board cover 241 is provided to cover the circuit board 240.

The circuit board 240 is known by those skilled in the art and is provided with a circuit pattern, an upper surface of which is connected to the upper plug connection terminal unit 220 and a lower surface of which is connected to the lower plug connection terminal unit 230.

Accordingly, once the connection plug 200 has been connected to the socket 100, the upper and lower plug connection terminal units 220 and 230 are connected respectively to corresponding connection terminal units of the socket 100 and may individually or simultaneously perform a plug function under assistance of the circuit pattern of the circuit board 240.

Hereinafter, an assembly method of the connection plug for a portable device will be described in detail with reference to the drawings.

Figure 5A:
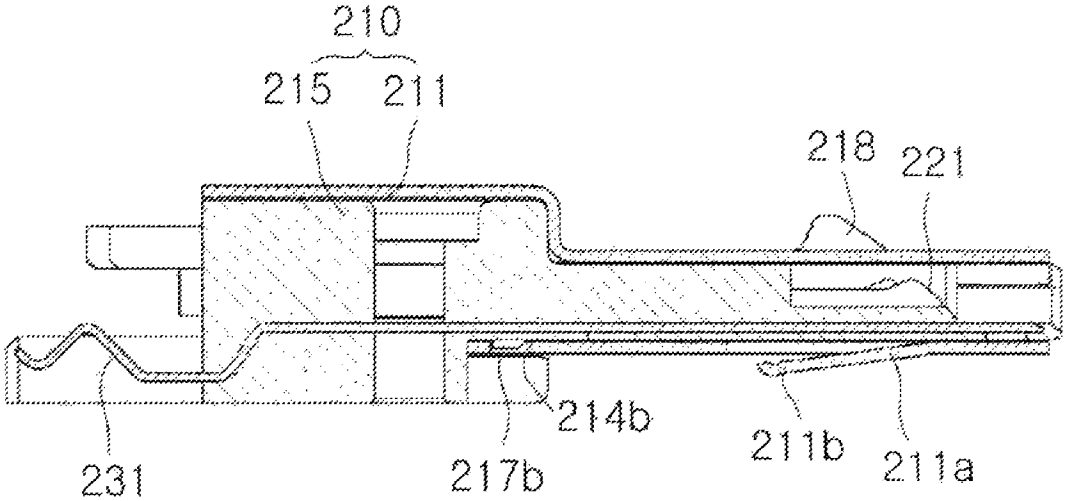
FIG. 5A is a sectional view of a lower plug connection terminal unit of the connection plug according to the invention.
Figure 5B:
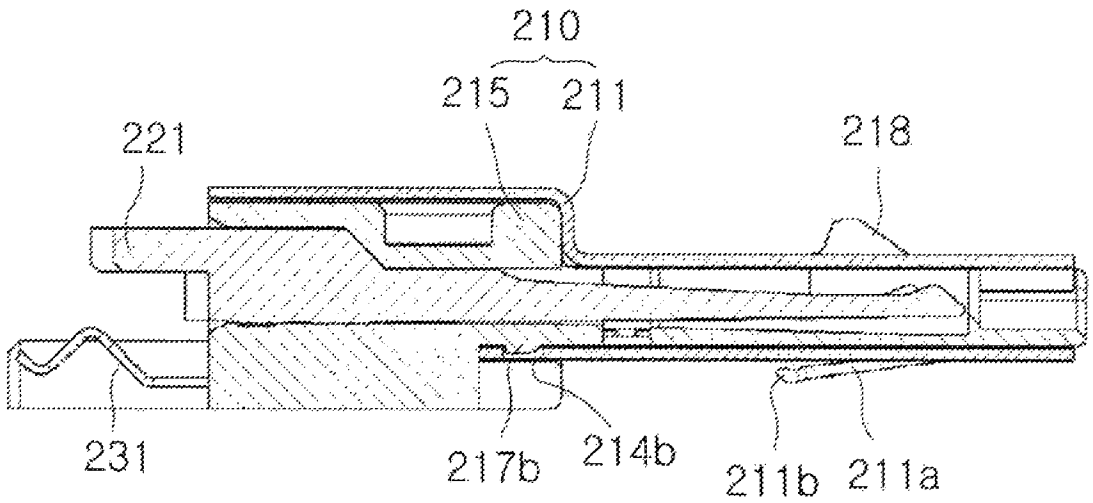
FIG. 5B is a sectional view of an upper plug connection terminal unit of the connection plug according to the invention.

First, with reference to FIGS. 5A and 5B, the terminal installation case 215 is insert injection molded in a state in which the lower plug connection terminals 231 are arranged. In this case, the lower plug connection terminals 231 are insert injection molded such that the upper surfaces of the lower plug connection terminals 231 are exposed from the lower insertion grooves 212*a* of the injection molded lower mount 212.

Next, the upper plug connection terminals 221 are inserted through the upper terminal receiving passageways 216*a* perforated in the rear end of the injection molded terminal installation case 215, such that the upper surfaces of the upper plug connection terminals 221 are exposed from the upper insertion grooves 213*a* formed in the upper mount 213.

Figure 6:
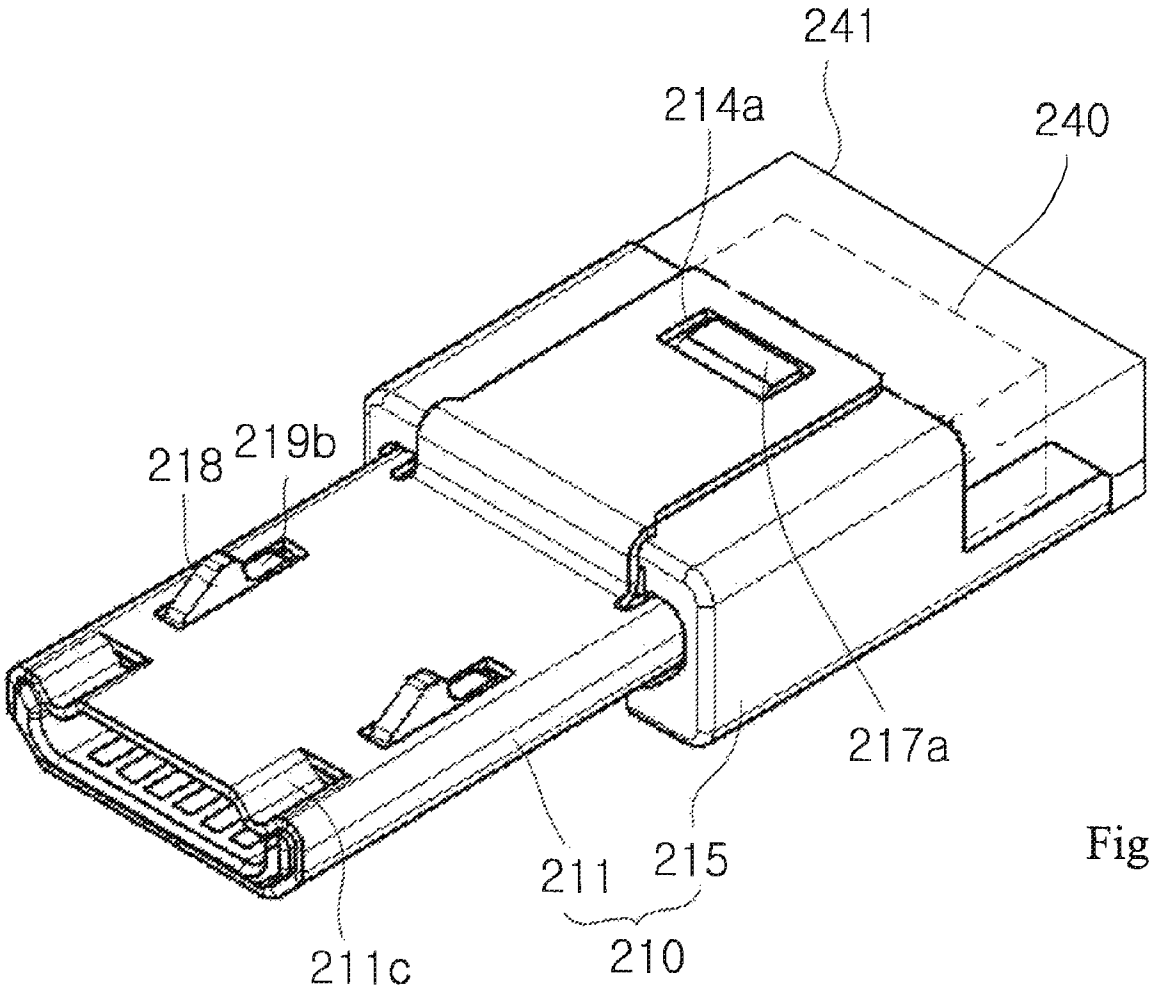
FIG. 6 is a perspective view showing a socket for use with the connection plug according to the invention.

Next, as shown in FIG. 6, the insertion case 211 is coupled to the terminal installation case 215 so as to surround the front portions of the upper and lower plug connection terminal units 220 and 230. More specifically, the upper coupling boss 217*a* of the terminal installation case 215 is inserted into the upper coupling boss receiving passageway 214*a* of the insertion case 211 and the lower coupling boss 217*b* of the terminal installation case 215 is inserted into the lower coupling boss receiving passageway 214*b* of the insertion case 211, whereby the insertion case 211 and the terminal installation case 215 are assembled with each other.

Simultaneously, the socket coupling bar 218, which is provided along the terminal installation case 215, protrudes upward through the coupling bar exposure slot 219*b* perforated in the insertion case 211.

Next, the circuit board 240 is interposed between the upper plug connection terminals 221 and the lower plug connection terminals 231 located at the rear side of the terminal installation case 215, and the circuit board cover 241 is placed to cover the circuit board 240 behind the terminal installation case 215. In this way, the connection plug 200 is completely assembled.

As described above, in the shown embodiment, the insertion case 211 and the terminal installation case 215 are individually fabricated by injection molding, the lower plug connection terminal unit 230 is insert injection molded upon injection molding of the terminal installation case 215, the upper plug connection terminal unit 220 is simply inserted into the terminal installation case 215, whereby the insertion case 211 can be simply assembled to the terminal installation case 215, resulting in simplified assembly of the connection plug 200.

Hereinafter, the configuration of the socket to be connected to the connection plug for a portable device in accordance with the present invention and a coupling relationship between the connection plug and the socket will be described in detail with reference to the drawings.

Figure 7A:
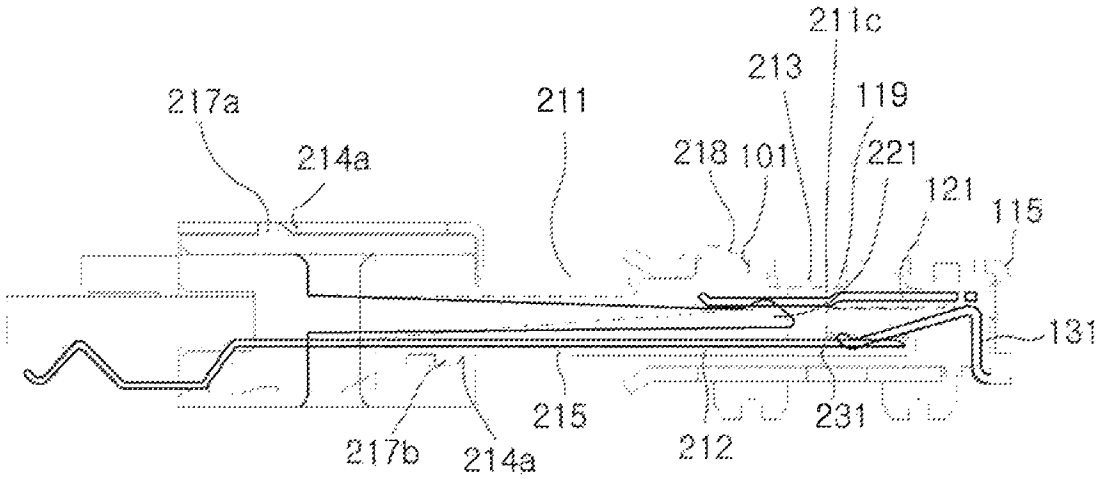
FIG. 7A is a sectional view of the socket and the connection plug according to the invention.
Figure 7B:
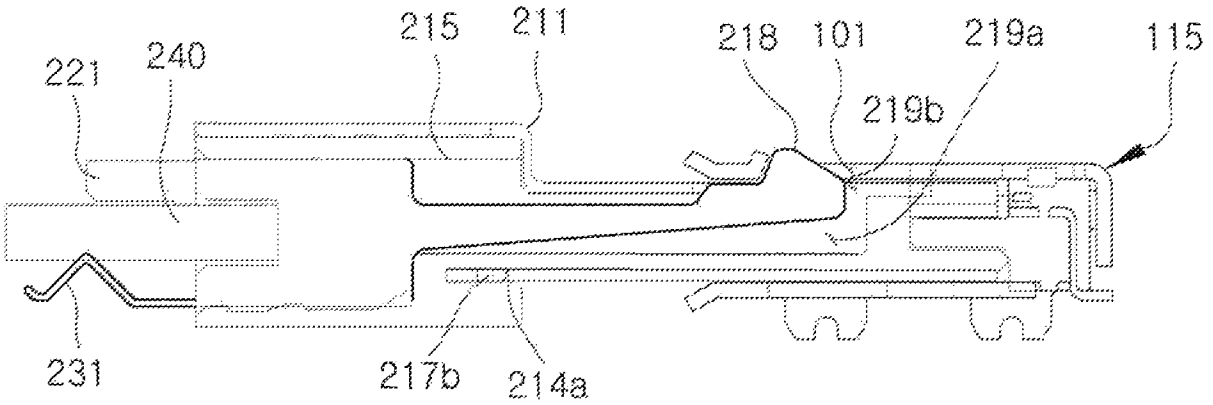
FIG. 7B is another sectional view of the socket and the connection plug according to the invention.

With reference to FIGS. 7A and 7B, the socket 100 is embedded in an electronic device, such as a portable device, etc. Once the connection plug 200 has been connected to the socket 100, the electronic device can be connected to another device through the connection plug 200 for the purpose of battery charge or information reception/transmission. The socket 100 may have a configuration corresponding to the connection plug 200 in accordance with PT sent invention so as to be used only for the connection plug 200. The socket 100 may include an outer case 115 in which upper connection terminals 121 and lower connection terminals 131 are accommodated so as to be respectively connected to the upper plug connection terminals 221 and the lower plug connection terminals 231 of the connection plug 200.

More specifically, the upper and lower connection terminals 121 and 131 are alternately arranged at staggered positions so as not to face each other, in the same manner as the upper and lower plug connection terminals 221 and 231. In contrast to the upper and lower plug connection terminals 221 and 231, the upper connection terminals 121 are longer than the lower connection terminals 131.

A plug coupling receiving passageway 101 is perforated in an upper surface of the outer case 115 such that the socket coupling bar 218 of the connection plug 200 is inserted into the plug coupling receiving passageway 101. In addition, an insertion guide 119 is formed inside the outer case 115 so as to be inserted into the insertion guide receiving space 211*c* of the insertion case 211.

Explaining a coupling relationship between the connection plug 200 and the socket 100 with reference to FIG. 7A in detail, a user first orients the connection plug 200 such that the insertion case 211 of the connection plug 200 faces the interior of the socket 100 and then, pushes the insertion case 211 into the socket 100.

In this case, the insertion case 211 is introduced into the socket 100 as the elastic insert 211*a* obliquely protruding downward from the lower surface of the insertion case 211 is urged toward the lower surface of the insertion case 211.

The curved surface 211*b* provided at the end of the elastic insert 211*a* serves not only to ground the connection plug 200 and the socket 100 with each other, but also to prevent the insertion case 211 from fully coming into close contact with the socket 100 while the insertion case 211 is introduced into the socket 100, thereby minimizing friction.

More specifically, because the curved surface 211*b* is an outwardly convex curved surface, the curved surface 211*b* comes into contact with the socket 100 while the insertion case 211 is inserted into the socket 100, which can minimize friction. In this way, the insertion case 211 can be stably inserted into the socket 100 with minimum friction and moreover, elasticity of the elastic insert 211*a* can enhance a coupling force between the connection plug 200 and the socket 100.

Referring to FIG. 7B, the insertion case 211 is introduced into the socket 100 until the socket coupling bar 218 provided at the terminal installation case 215 is inserted into the plug coupling receiving passageway 101 perforated in the upper surface of the socket 100, whereby the connection plug 200 is completely connected to the socket 100. In this case, the elastic insert 211*a* is forced to protrude outward by the lower surface of the insertion case 211, thereby acting to increase the coupling force between the connection plug 200 and the socket 100.

Once the connection plug 200 has been connected to the socket 100, the upper and lower plug connection terminals 221 and 231 of the connection plug 200 are connected respectively to the upper and lower connection terminals 121 and 131 of the socket 100. As such, the connection plug 200 can serve to connect the portable device having the socket 100 with another electronic device.

In this case, although the upper plug connection terminals 221, each having the upwardly bulged end, are urged downward when being connected to the upper connection terminals 121 of the socket 100, the upper plug connection terminals 221 do not interfere with the lower plug connection terminals 231 because the upper and lower plug connection terminals 221 and 231 are alternately arranged at staggered positions.

Accordingly, the connection plug 200 can be coupled to the socket 100 and simultaneously, the different kinds of plug connection terminals of the connection plug 200 can be connected to the connection terminals of the socket 100. In such a state, the circuit board 240 may be connected to the respective plug connection terminals, so as to allow the different kinds of plug connection terminals to be selectively independently used or to perform different operations simultaneously.

As a result, in the connection plug according to the invention, different kinds of plugs are installed to a single case and each plug is connected to a socket simultaneously with being inserted into the socket, which can enable a single connection plug to exhibit two functions.

As is apparent from the above description, according to the invention, different kinds of upper and lower plug connection terminal units are installed to a single case, whereby a single connection plug can perform different kinds of operations. This has the effect of reducing the number of connection plugs for use with a portable device, resulting in convenient carrying of the connection plugs.

Further, according to the invention, a circuit board, which is connected to two different kinds of plug connection terminal nits, is located between the two plug connection terminal units. This can minimize an installation space of the circuit board and allow the respective plug connection terminal units of the single connection plug to be independently or simultaneously operated.

Furthermore, according to the invention, terminal receiving passageways of the case are arranged at staggered positions to allow the different kinds of plug connection terminal units to be alternately arranged at staggered positions, and each plug connection terminal unit is installed such that upper surfaces of plug connection terminals thereof are exposed so as to be connected to connection terminals of a socket. This can prevent interference upon connection of the socket, ensuring stable connection between the connection plug and the socket.

In particular, according to the invention, as lower plug connection terminals are insert injection molded to a terminal installation case and upper plug connection terminals are inserted into and assembled with the terminal insertion case, the entire assembly of the connection plug can be simplified, which results in enhancement in productivity.

According to the invention, the connection plug is provided with a socket coupling bar, which serves to couple the connection plug with the socket when the connection plug is inserted into the socket. Accordingly, the connection plug can be coupled with the socket simultaneously with being inserted into the socket, which can prevent the connection plug from being unintentionally easily separated from the socket upon receiving external pressure, ensuring stable connection between the connection plug and the socket.

According to the invention, the socket coupling bar is bent upward by an inclination suitable to exhibit elasticity, which assists in a user easily coupling or separating the connection plug to or from the socket.

In addition, according to the invention, an insertion case is provided to surround a front portion of the terminal installation case, which can protect the plug connection terminal units from external shock.

According to the invention, the insertion case is provided with an insertion guide receiving space, which serves to prevent the insertion case from being excessively or insufficiently inserted into the socket, thereby preventing the respective terminals from failing to be connected to terminals of the socket.

According to the invention, the different kinds of plug connection terminal units are arranged at staggered positions within the single plug, which can admit reducing the size of the entire connection plug.

In particular, according to the invention, in the configuration in which different kinds of upper and lower plug connection terminals are alternately arranged at staggered positions, a width of the upper or lower plug connection terminals corresponds to a distance between the lower or upper plug connection terminals and a length of the upper or lower plug connection terminals is greater than a length of the lower or upper plug connection terminals, which can prevent interference between the terminals and consequently, admit the connection plug effectively performing functions thereof.

Although the exemplary embodiment of the invention has been disclosed for illustrative purposes, those skilled in the art will appreciate that various modifications, additions and substitutions are possible, without departing from the scope and spirit of the invention as disclosed in the accompanying claims.

What is claimed is:

1. A connection plug for a portable device, the connection plug comprising:

a case having an upper plug connection terminal unit having a plurality of upper plug connection terminals equidistantly spaced apart from one another by a predetermined distance, each upper plug connection terminal having a pair of opposite substantially planar side surfaces along an entire length thereof, and a lower plug connection terminal unit having a plurality of lower plug connection terminals configured to have a width equal to or less than the predetermined distance between the plurality of upper plug connection terminals and being staggered apart from the plurality of upper plug connection terminals;

wherein the upper plug connection terminal unit and the lower plug connection terminal unit disposed along separate planes corresponding to upper and lower portions of the case respectively.

2. The connection plug according to claim 1, further comprising a circuit board connected to the upper plug connection terminal unit and the lower plug connection terminal unit.

3. The connection plug according to claim 2, wherein the circuit board sends or receives electric signals to or from the upper plug connection terminal unit and the lower plug connection terminal unit.

4. The connection plug according to claim 2, wherein a rear end of the upper plug connection terminal unit is connected to an upper surface of the circuit board and a rear end of the lower plug connection terminal unit is connected to a lower surface of the circuit board.

5. The connection plug according to claim 4, further comprising a terminal installation case to which the upper plug connection terminal unit and the lower plug connection terminal unit are individually installed.

6. The connection plug according to claim 5, wherein the terminal installation case includes a lower mount having a lower insertion groove into which each of the plurality of lower plug connection terminals are assembled.

7. The connection plug according to claim 6, wherein each of the plurality of lower plug connection terminals includes an exposed upper surface.

8. The connection plug according to claim 6, wherein the terminal installation case further includes an insert molded upper mount having an upper insertion groove into which each of the plurality of upper plug connection terminals of the upper plug connection terminal unit is assembled.

9. The connection plug according to claim 8, wherein each of the plurality of upper plug connection terminals includes an exposed upper surface.

10. The connection plug according to claim 9, wherein a length of the insert molded upper mount is less than a length of the lower mount.

11. The connection plug according to claim 10, wherein the insert molded upper mount is positioned above the lower mount so as to be stepped with respect to the lower mount.

12. The connection plug according to claim 8, wherein the lower insertion groove and the upper insertion groove are alternately arranged at staggered positions.

13. The connection plug according to claim 8, wherein the insert molded upper mount includes a socket coupling bar having an upwardly bulged end.

14. The connection plug according to claim 13, wherein the socket coupling bar is bent upward such that the upwardly bulged end is exposed through a coupling bar exposure slot.

15. The connection plug according to claim 5, wherein the case further includes an insertion case configured to be connected with the terminal installation case to cover a front portion of the terminal installation case.

16. The connection plug according to claim 1, wherein the plurality of upper and lower plug connection terminals being alternately arranged at staggered positions so as not to come into contact with each other during upward or downward movement thereof.

17. The connection plug according to claim 16, wherein a distance between the plurality of upper plug connection terminals corresponds to a width of the plurality of lower plug connection terminals.

* * * * *